US006491531B1

(12) United States Patent
Reinmueller et al.

(10) Patent No.: US 6,491,531 B1
(45) Date of Patent: Dec. 10, 2002

(54) PLUG-IN CONNECTOR FOR AN IGNITION SYSTEM IN A MOTOR VEHICLE

(75) Inventors: Dieter Reinmueller, Ludwigsburg; Richard Gehrig, Tauberbischofsheim, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/495,156

(22) Filed: Jan. 31, 2000

(30) Foreign Application Priority Data

Dec. 14, 1998 (DE) ..... 198 57 484

(51) Int. Cl.[7] ..... H01R 13/46

(52) U.S. Cl. ..... 439/125; 439/440; 439/787; 439/654

(58) Field of Search ..... 439/125, 440, 439/787, 654

(56) References Cited

U.S. PATENT DOCUMENTS 5,409,388 A * 4/1995 Phillips, Jr. et al. ..... 439/125

5,547,387 A * 8/1996 Kobayashi ..... 439/125

FOREIGN PATENT DOCUMENTS

EP 0 713 005 5/1996

* cited by examiner

*Primary Examiner*—Tho D. Ta
*Assistant Examiner*—Truc Nguyen
(74) *Attorney, Agent, or Firm*—Kenyon & Kenyon

(57) ABSTRACT

A plug-in connector between an ignition coil and a spark plug is designed so that the longitudinal tolerances cause no undesired coupling of the plug-in connector to the spark plug. When the plug-in connector is brought together with the ignition coil to form a pre-assembly unit, a latch connection is formed between a first socket of the plug-in connector and a coil stud, which can absorb the joining forces of this pre-assembly unit on the spark plug without deformation. After full coupling with the spark plug, further setup movement of the pre-assembly unit, in which the remaining assembly clearances are compensated, result in the first socket being latched on the coil stud and the longitudinal tolerances being internally compensated by the first socket being slid onto a press-over section of the coil stud. The plug-in connector is intended in particular for use in ignition systems of automobiles.

3 Claims, 2 Drawing Sheets

PLUG-IN CONNECTOR FOR AN IGNITION SYSTEM IN A MOTOR VEHICLE

BACKGROUND INFORMATION

A plug-in connector is described in European Patent Application No. 713 005. The plug-in connector is arranged in an electrically conductive manner between a high-voltage output of an ignition coil and the terminal section of a spark plug. The plug-in connector is mounted rigidly on the ignition coil and in a longitudinally displaceable manner, via a plug-and-socket connection, on the spark plug. While the spark plug is screwed into a pocket of a cylinder head of the internal combustion engine, the ignition coil rests on a cover surface of the cylinder head at the free end of the pocket and is rigidly secured here as is the spark plug.

When the plug-in connector is mounted, the dimensional tolerances of the spark plug, pit, and ignition coil result in length tolerances of up to 5 mm. Since the plug-in connector is rigidly connected to the ignition coil, the tolerance is compensated at the spark plug. This may result in an undesirable overlapping of the plug-in connector over the terminal section of the spark plug.

As a result of such a partial high-voltage overlapping of the plug-in connector over the connection section of the spark plug, undesirable high-voltage sparkover may occur at the terminal section of the spark plug.

SUMMARY OF THE INVENTION

The plug-in connector according to the present invention, in particular for ignition systems of motor vehicles, has the advantage over the related art that the above-mentioned shortcoming is eliminated. For this purpose, the plug-in connector is provided with sockets at both of its ends. A first socket is latched on a stud of the ignition coil so it can be pressed over, forming a pre-assembly unit between the ignition coil and the plug-in connector.

When the pre-assembly unit is mounted on a spark plug, a protective jacket of the plug-in connector slides onto an insulator of the spark plug up to a predefined end position. This slide path is limited by a stop, which is incorporated in a second socket of the plug-in connector and on which a terminal stud of the spark plug comes to rest. In addition, the second socket latches onto the terminal stud.

If the set-up motion continued, the first socket may unlatch and move to a press-over section of the coil stud to compensate the assembly tolerances.

This ensures that the protective jacket always adequately covers the insulator of the spark plug regardless of the assembly tolerances, and tolerance compensation can take place at the connection between the plug-in connector and the ignition coil.

DETAILED DESCRIPTION

Figure 1:
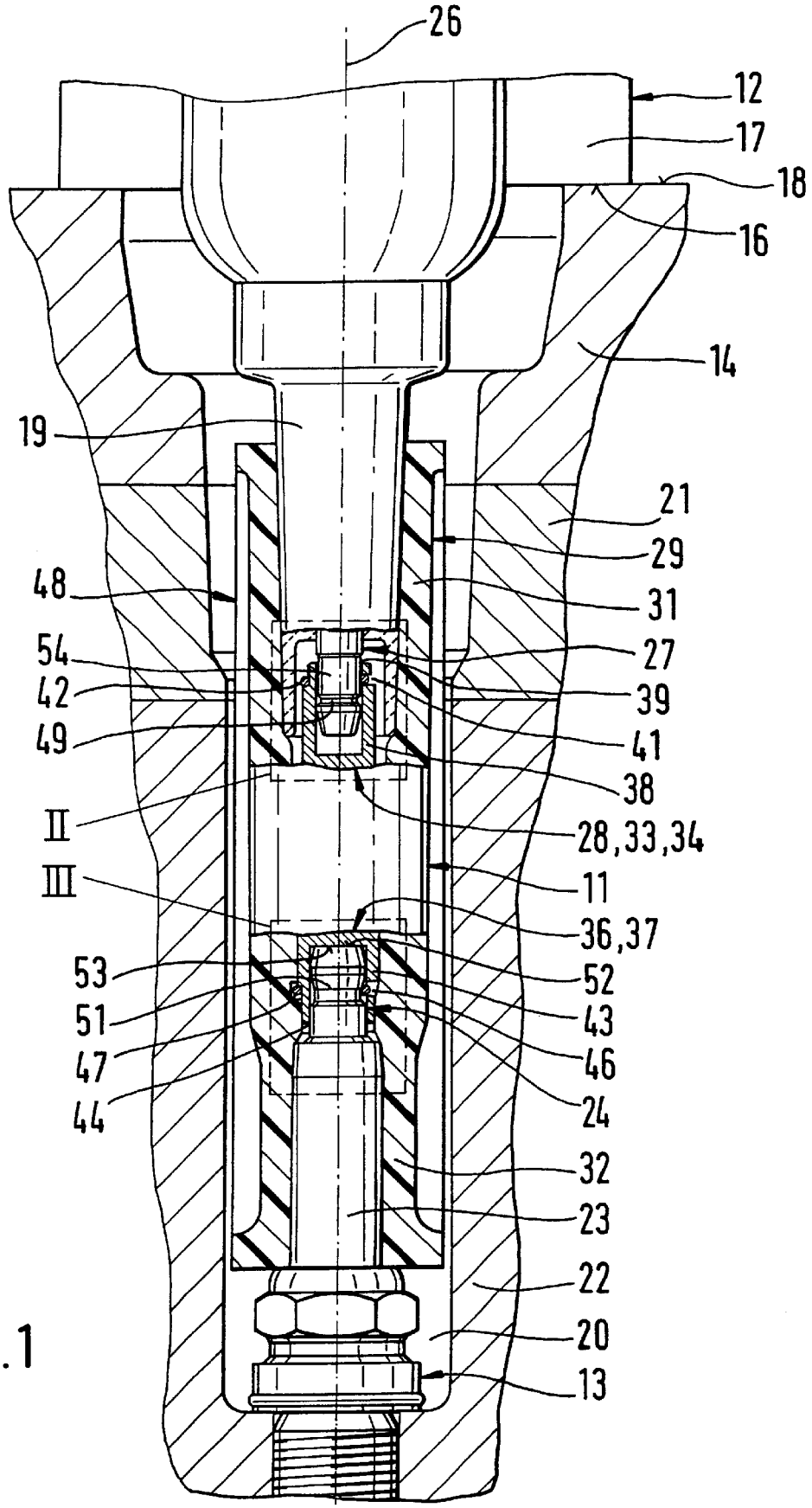
FIG. 1 illustrates a section showing the sections of a plug-in connector and parts of an ignition system.

A plug-in connector 11, used in particular in an ignition system of a motor vehicle, is designed to be connected to an ignition coil 12 and a spark plug 13, as shown in FIG. 1.

Ignition coil 12 is attached in the known manner to a cylinder head cover 14 of an internal combustion engine of the vehicle and in an assembly position representing the operation-ready state comes to rest on a cover surface 18 of cylinder head cover 14 with bottom 16 of a housing 17.

Ignition coil 12 protrudes, in particular with a high-voltage dome 19, into a pocket hole 20 starting from cylinder head cover 14, continuing through an intermediate plate 21, and ending in cylinder head 22. Spark plug 13 is securely screwed in here in pocket 20, with insulator 23 and a terminal stud 24 passing through it and protruding at its free end along a central longitudinal axis 26 of pocket 20, pointing toward ignition coil 12.

High-voltage dome 19 of ignition coil 12, which is also made of electrically insulating material, surrounds a coil stud 27, which protrudes from high-voltage dome 19 at its free end. Coil stud 27 coaxially faces terminal stud 24 and, like it, is electrically conductive.

Plug-in connector 11 represents the electric connection between coil stud 27 and terminal stud 24.

Essentially cylindrical plug-in connector 11 has a centrally positioned rod-shaped contact part 28 and a protective jacket 29 that is coaxial thereto.

Protective jacket 29 is made of tough silicone rubber and surrounds electrically conductive contact part 28 with a pressure fit and undercuts, so that it cannot be displaced within protective jacket 29.

Protective jacket 29 extends over contact part 28 on both sides in the axial direction along longitudinal axis 26. These extensions are connected at one end 31 to high-voltage dome 19 and, at the opposite end 32, to insulator 23.

Figure 2:
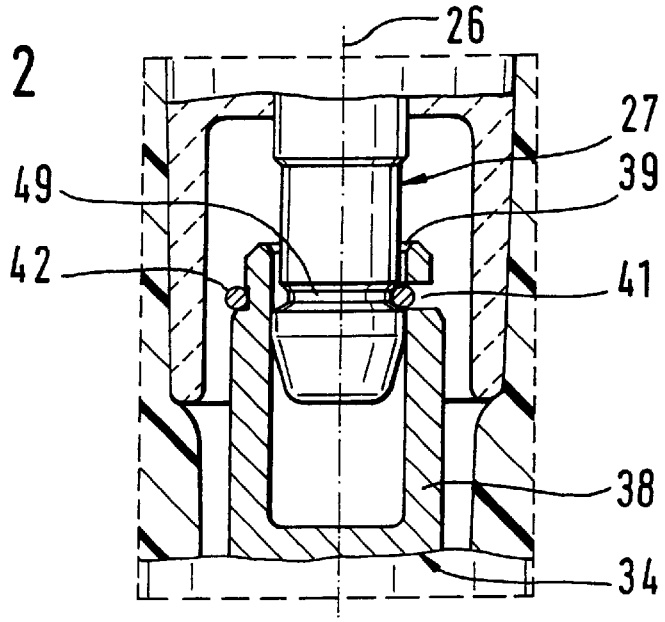
FIG. 2 shows section II, as a detail of FIG. 1, in a pre-assembly position of the plug-in connector on an ignition coil.

First end section 33 of contact part 28 has a first socket 34 and the opposite end section 36 has a second socket 37. The design of sockets 34, 37 is essentially known. FIG. 2 shows, for first socket 34, a shell-shaped first wall 38 having a first connecting hole 39 at its free end; a first slot 41 over part of first wall 38; a first contact spring 42, which is placed in first slot 41 and protrudes into first socket 34 through slot 41 with one part of its peripheral extension and is capable of bouncing off it peripherally. Similarly, for second socket 37, FIG. 2 shows second wall 43, second connecting hole 44, second slot 46, and second contact spring 47.

Plug-in connector 11 is pushed onto high-voltage dome 19 of ignition coil 12 with one end 31 of protective jacket 29 to form a pre-assembly unit 48 between ignition coil 12 and plug-in connector 11 until first socket 34 latches onto ignition coil stud 27. As FIG. 2 shows, first contact spring 42 latches into a first groove 49, which extends perpendicularly to longitudinal axis 26 over the periphery of coil stud 27.

Figure 3:
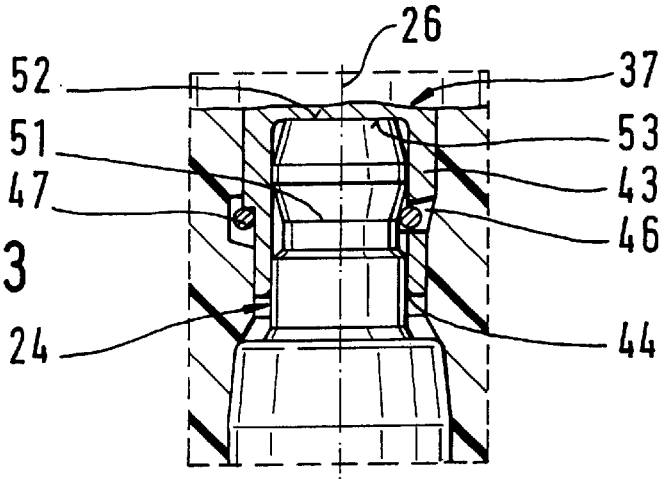
FIG. 3 shows section III in an assembly position of the plug-in connector on a spark plug.

This pre-assembly unit 48, which is stable per se, is set on spark plug 13 flush to longitudinal axis 26 and pushed until the other end 32 of protective jacket 29 comes into a predefined end position on insulator 23, in which the latter is adequately covered in order to prevent voltage sparkovers when spark plug 12 is operated. As FIG. 3 shows, second contact spring 47 latches into a second groove 41, which extends perpendicularly to longitudinal axis 26 over the periphery of terminal stud 24.

Contrary to first groove 49, second groove 51 has a flatter design, which results in lower latching forces.

With second socket 37 latching on terminal stud 24, one end face 52 at the free end of terminal stud 24 comes to rest on a stop 53, which forms the bottom of second socket 37.

Figure 4:
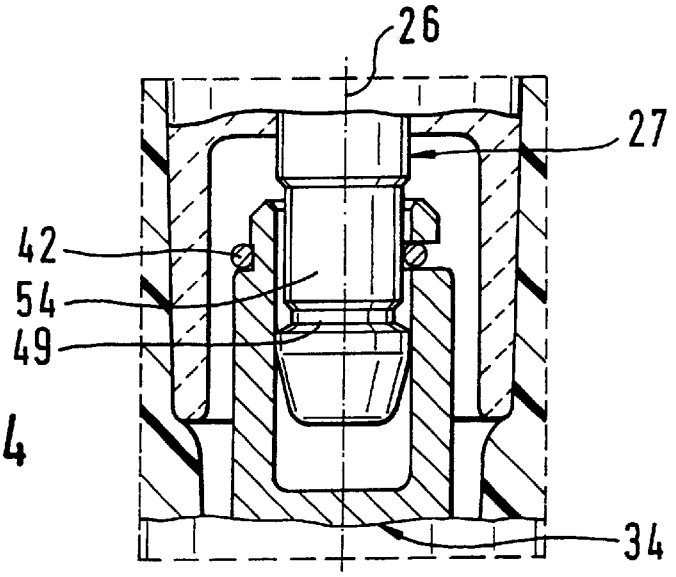
FIG. 4 shows section II in an assembly position of the plug-in connector on the spark plug.

If the set-up motion of pre-assembly unit 48 is continued until bottom 16 of housing 17 of ignition coil 12 comes to rest on cover surface 18 of cylinder head cover 14, pre-assembly unit 48, which previously absorbed the assembly forces of plug-in connector 11 on spark plug 13 without deformation, is now pushed together by the latch connection between first socket 34 and coil stud 27 being pressed over. First contact spring 42 slides out of first groove 49 and reaches, according to FIG. 4, a cylindrical press-over section 54 adjacent to first groove 49 of coil stud 27, facing away from its free end.

This ensures that when ignition coil 12 is fully set onto cylinder head cover 14, insulator 23 of spark plug 13 is always adequately covered and any excess length dimension of pre-assembly unit 48 on pocket 20 can be compensated by an internal longitudinal displacement on the ignition coil side.

In the event of a disengaging movement in the direction opposite to the set-up motion, first contact spring 42 slides back onto press-over section 54 until it latches into first groove 49. This latch connection between first socket 34 and coil stud 27 is so stable that pre-assembly unit 48 can absorb the assembly forces of plug-in connector 11 and spark plug 13 without changes in length by pulling off of the other end 32 of protective jacket 29 from insulator 23 and disengaging the latch connection between second socket 37 and terminal stud 24 of spark plug 13.

What is claimed is:

1. A plug-in connector for an ignition system in a motor vehicle, comprising:

a protective jacket having a first end for connecting to an ignition coil and having a second end adapted to be pushed onto an insulator of a spark plug; and a contact part situated in the protective jacket, the contact part having a first end section for connecting to the ignition coil and having a second end section for coming to rest on a terminal stud of the spark plug, the first end section having a first socket, the first socket being selectively latchable onto a coil stud of the ignition coil while the contact part is situated in the protective jacket so that the first socket can be pressed over to form a preassembly unit between the ignition coil and the plug-in connector, the second end section having a second socket, the second socket entering a latch connection on the terminal stud of the spark plug when the pre-assembly unit is set on the spark plug up to a predefined end position of the second end of the protective jacket on the insulator, the terminal stud then coming to rest on a stop of the second socket, the first socket being displaced to a press-over section on the coil stud when a set-up motion of the pre-assembly unit on the spark plug is continued while the contact part is situated in the protective jacket.

2. The plug-in connector according to claim 1, wherein latching forces between the first socket and the coil stud are greater than assembly forces of the plug-in connector on the spark plug with the second end of the protective jacket being pushed onto the insulator and the second socket being latched onto the terminal stud.

3. The plug-in connector according to claim 2, wherein, for a detachment movement opposite to the set-up motion, the first socket latches again onto the coil stud from the press-over section, and wherein, if the detachment movement is continued preserving a latch connection between the first socket and the coil stud, the pre-assembly unit is detachable from the spark plug.

* * * * *